United States Patent [19]

Harkus

[11] Patent Number: 4,913,343

[45] Date of Patent: Apr. 3, 1990

[54] ELECTRICAL INSULATOR FOR INSULATING A RAILWAY RAIL-FASTENING CLIP FROM A RETAINING MEMBER FOR IT

[75] Inventor: Lance Harkus, Carlingford, Australia

[73] Assignee: Pandrol Limited, London, Great Britain

[21] Appl. No.: 260,175

[22] Filed: Oct. 19, 1988

[30] Foreign Application Priority Data

Oct. 19, 1987 [AU] Australia ..... 7991487

[51] Int. Cl.[4] ..... E01B 9/30

[52] U.S. Cl. ..... 238/351; 238/349

[58] Field of Search ..... 238/351, 315, 318, 343, 238/344, 345, 348, 352, 353, 354, 355, 350, 310, 377, 378, 264, 349, 338, 227

[56] References Cited

U.S. PATENT DOCUMENTS

| | | | |
|---|---|---|---|
| 3,326,466 | 6/1967 | Sanson | 238/349 |
| 4,067,495 | 1/1978 | Qureshi | 238/349 |

FOREIGN PATENT DOCUMENTS

| | | | |
|---|---|---|---|
| 0543755 | 1/1956 | Belgium | 238/349 |
| 0095210 | 11/1983 | European Pat. Off. | 238/343 |
| 8502313 | 3/1987 | Netherlands | 238/338 |
| 0000727 | 10/1979 | PCT Int'l Appl. | 238/349 |
| 1039017 | 8/1966 | United Kingdom . | |
| 1044884 | 10/1966 | United Kingdom | 238/349 |
| 1549623 | 8/1979 | United Kingdom . | |

*Primary Examiner*—Andres Kashnikow
*Assistant Examiner*—Mark T. Le
*Attorney, Agent, or Firm*—Norbert P. Holler

[57] ABSTRACT

A bushing of electrically insulating material has a passageway, of elongate cross-section, through it. The bushing is inserted in a clip-retaining member and the latter is supported in a mould into which a wet cement mix is poured so that a concrete railway sleeper is formed and the clip-retaining member is held in the concrete with the passageway above the concrete. A center arm and an upper arm of a substantially e-shaped clip are driven into the passageway and a lower arm of the clip bears downwardly on a flange of a railway rail.

15 Claims, 4 Drawing Sheets

ELECTRICAL INSULATOR FOR INSULATING A RAILWAY RAIL-FASTENING CLIP FROM A RETAINING MEMBER FOR IT

FIELD OF THE INVENTION

This invention relates to an electrically insulating bushing and a railway rail-and-fastening assembly including the bushing.

PRIOR ART

It is known to drive only the centre arm of a railway rail-fastening clip, which is substantially e-shaped as seen in plan view, into an opening in a retaining member for the clip, part of which retaining member is incorporated in a concrete railway sleeper (the words "railway sleeper" is used herein to mean what is often called a "rail tie"). It is also known, from United Kingdom Patent Specification No. 1,039,017, to insert an electrically insulating bushing, that is to say a body of electrically insulating material having a passageway through it which is surrounded by the insulating material, into the opening in the clip-retaining member and to drive only the centre arm of the same type of clip into the passageway through the bushing, so that the bushing electrically insulates the clip from the clip-retaining member, one of the upper and lower arms of the e bearing downwardly on a flange at the base of the rail, which it directly contacts, and the other one of these arms bearing downwardly on a fixed surface which is beyond the centre arm, as seen from the rail. The bushing is part of an insulating arrangement which electrically insulates the rail from the sleeper, which is necessary if the rail is to carry electric currents which are used for signalling. The bushing is not described in detail or illustrated in Specification No. 1,039,017 but one would expect it to have a cross-section which is a circular annulus, to suit the clip and the clip-retaining member, which are described and illustrated in the specification.

A RELATED INVENTION

In another patent application Ser. No. 260,176 filed on the same date as this one, it is proposed to make the substantially e-shaped clip flat except possibly at the free end of the lower arm of the e and to drive the centre arm and the upper arm of the clip into the passageway through the bushing.

OBJECT OF THE INVENTION

It is an object of the present invention to provide an electrically insulating bushing which can be inserted in an opening in a clip-retaining member, the bushing being constructed to receive not only the centre limb of a substantially e-shaped clip but also the upper limb of the e.

OUTLINE OF THE INVENTION

According to a first aspect of the invention, there is provided a bushing which is suitable for electrically insulating a railway rail-fastening clip from a retaining member for it, the bushing having an internal passageway of elongate cross-section and externally the bushing having on its lower side two flat surfaces inclined to one another by an angle which is much greater than 90°.

According to a second aspect of the invention, there is provided a device which is suitable for electrically insulating a railway rail-fastening clip from a retaining member for the clip, the device being a body of electrically insulating material having a passageway through it for reception of part of the clip, the shape of cross-section of at least part of the passageway being substantially the shape of a conventional athletics race track, with two substantially straight and substantially parallel sides and two substantially semi-circular ends, and in a particular orientation of the body substantially a flat external upper surface of the body is substantially horizontal and the substantially straight and parallel sides of the cross-section of the passageway are inclined to the horizontal.

According to a further aspect of the invention, there is provided an assembly comprising a concrete railway sleeper, a clip-retaining member comprising anchoring means incorporated in the concrete and also having a clip-retaining part projecting above the concrete and formed with an opening, an insulating device which is a bushing or device according to the first or the second aspect of the invention and which is suitable for electrically insulating a railway rail-fastening clip from the clip-retaining part, the insulating device lying in said opening.

INTRODUCTION TO THE DRAWINGS

A bushing and an assembly in accordance with the invention are described below with reference to the accompanying drawings, in which:

FIG. 1 shows a plan view of the bushing,

FIG. 2 shows an end view of the bushing, taken as indicated by the arrow II in FIG. 1, FIG. 3 shows a cross-sectional view of the bushing, taken as indicated by the arrows III in FIG. 2, FIG. 4 shows a side view of the bushing, taken as indicated by the arrow IV in FIG. 1, and FIG. 5 shows an end view of the bushing, taken as indicated by the arrow V in FIG. 1, FIG. 6 shows a part of a railway rail standing on a concrete railway sleeper and held down by a clip retained by a clip-retaining member, the clip being electrically insulated from the clip-retaining member by a bushing according to FIGS. 1 to 5, which is shown in simplified form, and FIG. 7 shows a plan view of the parts which are shown in FIG. 6.

DETAILED DESCRIPTION OF PARTS SHOWN IN THE DRAWINGS

Figure 5:
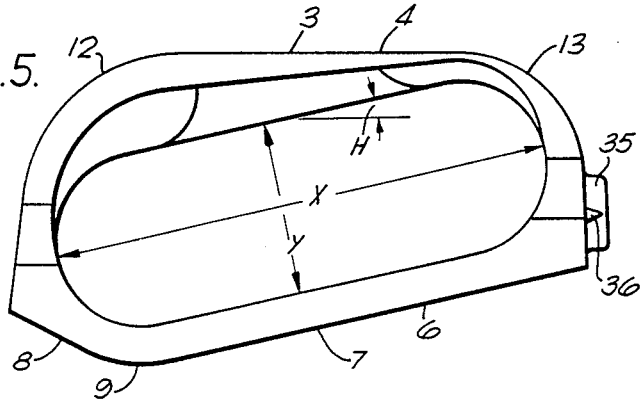

The bushing 1 shown in the drawings is made from electrically insulating material, for example nylon reinforced with glass fibres, by an injection moulding process. It has two flat upper surface 2 and 3 which in the illustrated orientation of the bushing (FIGS. 2 to 5) are oppositely inclined by about 1° to the horizontal (see FIG. 3) so that they form a ridge 4 extending across the top of the bushing. It also has two long flat lower surfaces 5 and 6 which are inclined by about 1° in opposite senses to the horizontal (see FIG. 3) so that they form a ridge 7 extending across the bottom of the bushing. The ridge 4 is horizontal but the ridge 7 is inclined to the horizontal by about 12.5° (see FIGS. 2 and 5). The two surfaces 2 and 3 are substantially a single flat horizontal surface and the two surfaces 5 and 6 are substantially a single flat surface inclined to the horizontal by about 12.5°. The bushing also has a shorter lower flat surface 8 which is inclined to the horizontal by about 27° and is joined to the surfaces 5 and 6 by a convex surface 9. The surface 8 could be replaced by two surfaces inclined by about 178° to one another so that they form substantially a single surface. On the left side (FIG. 2) there is substantially a flat external surface 10, which is inclined from right to left, proceeding downwardly, at an angle of about 3°. On the right side (FIG. 2) there is substantially a flat external surface 11 which is inclined to the vertical by an angle of about 7° in the opposite sense, so that the two surfaces 10 and 11 diverge from one another, proceeding downwardly. The surfaces 10 and 11 are joined to opposite sides of the surfaces 2 and 3 by convex external surfaces 12 and 13, respectively. To be more exact, on the left side there are two flat external surfaces 10A and 10B inclined to one another by about 179.5° and on the right side there are two flat external surfaces 11A and 11B inclined to one another by a similar angle.

Figure 2:
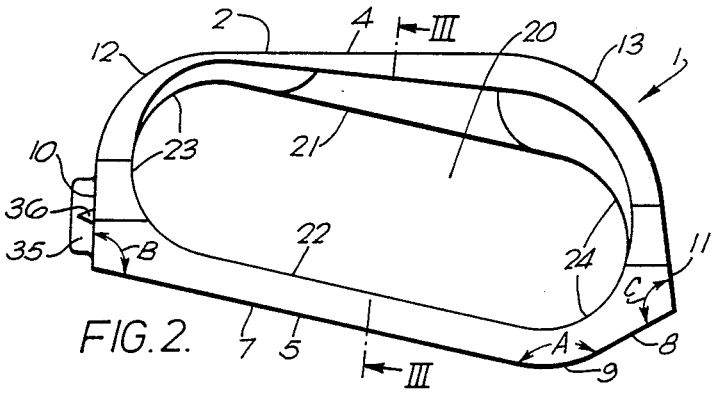
Figure 3:
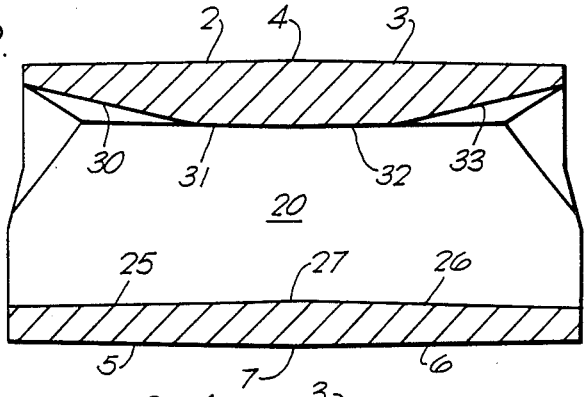
Figure 4:
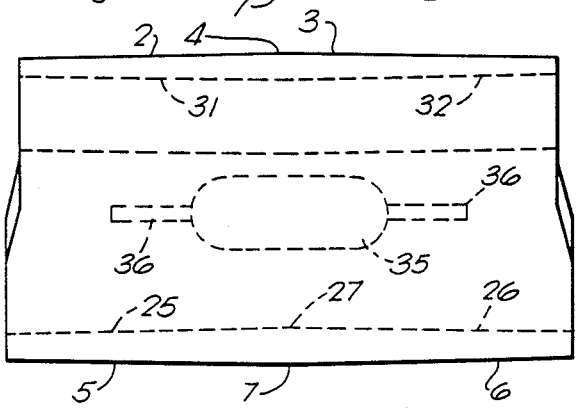

The bushing 1 has a passageway 20 extending through it, the length of the passageway extending from left to right in FIG. 3. At and near the centre of its length, the passageway has a cross-section which has substantially the shape of a conventional athletics race track, with two straight and parallel sides 21 and 22 and two substantially semi-circular ends 23 and 24 (see FIG. 2). The two parallel sides 21 and 22 of the cross-section of the passageway 20 are inclined to the horizontal by an angle H which is between 5° and 20°; in the illustrated case H is about 12.5°. Considering FIG. 3, it can be seen that the floor of the passageway has two flat surfaces 25 and 26 which are inclined by about 1° in opposite senses to the horizontal so that they form a ridge 27 extending across the floor of the recess. The roof of the passageway, proceeding from left to right in FIG. 3, has a portion 30 which slopes downwardly at about 13° to the horizontal, then a portion 31 which slopes downwardly at a smaller angle, about 1° to the horizontal, then a portion 32 which slopes upwardly at about 1° to the horizontal and then a portion 33 which slopes upwardly at about 13° to the horizontal. Thus the passageway 20 is smoothly increased in height at both ends. This is in order to facilitate the driving of a clip into the passageway 20.

The surfaces 25 and 26 form substantially a single flat surface and this is true also of the portions 31 and 32 of the roof of the passageway.

On one side only of the bushing there is a projection 35 extending from the surfaces 10A and 10B, the projection having substantially the same shape as an athletics race track as described above. At each end of the projection 35 there is a much narrower and less deep projection 36, the cross-section of which is V-shaped.

Figure 1:
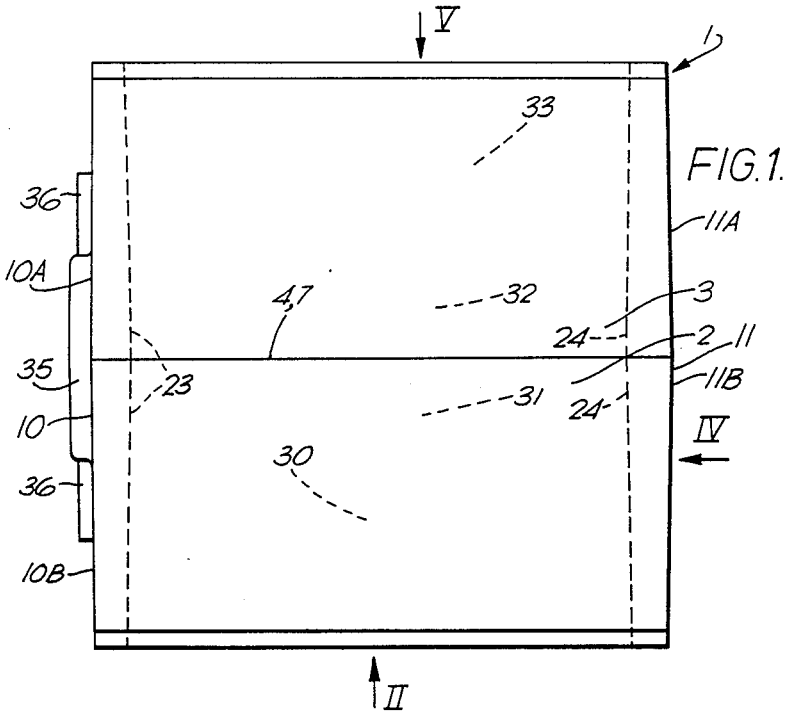

The bushing is about 65 mm long (measured vertically in FIG. 1), and the dimensions x and y (see FIG. 5) of the passageway 20 at the centre of its length are 55.75 mm and 19.0 mm, respectively.

Figure 6:
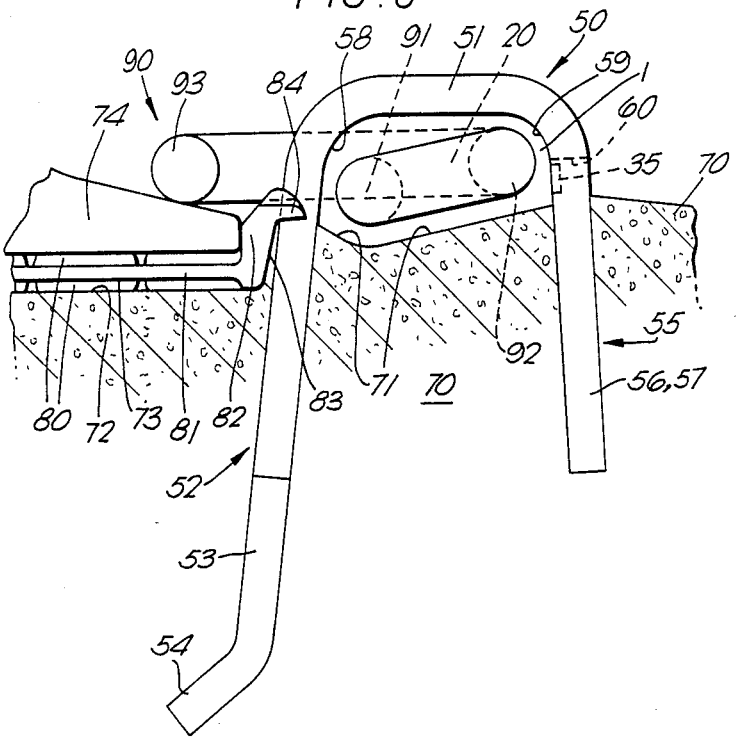

A clip-retaining member 50, made by bending a strip of sheet steel of rectangular cross-section and of width 60 mm, is in the form of an arch having a flat and horizontal top 51, a left side 52, the lower parts 53 and 54 of which are of constant width, less than the width of the remainder of the clip-retaining member, and a right side 55 consisting of two limbs 56 and 57, the limb 57 being behind the limb 56, considering FIG. 6, and spaced from it by a distance equal to the width of the parts 53 and 54. The flat top 51 is joined to the left side 52 and the right side 55 of the arch by curved portions which have internal surfaces 58 and 59 which match the curved surfaces 12 and 13, respectively, of the bushing. The bushing is manually push-fitted or power-driven into the upper part of the arch of the clip-retaining member 50, which it fits snugly, the projections 36 becoming flattened and the projection 35 lying between the limbs 56 and 57 just below their junction 60 with the remainder of the member 50. The lateral projection 35, therefore, lies in an opening in the member 50, whereby the bushing is located by that member.

Four such assemblies of clip-retaining member 50 and bushing 1 are suitably supported in a mould which is used to make concrete railway sleepers and a wet concrete mix is poured into the mould so that it sets around the parts of the clip-retaining members which are below the upper ends of the surfaces 7 and 8 of the bushing to form a sleeper 70. The bushings cause four recesses 71 to be formed in the top of the sleeper 70 and by other means two wider and deeper recesses 72 are formed in the top of the sleeper each of which receives a pad 73 of electrically insulating material on which stands the flange 74 of a flange-footed railway rail. The pad has recesses in its two opposite major faces whereby there are formed in each of these faces several islands 80 of the pad material which are joined together by a central web 81 of the pad material, the islands being in the form of chevrons which are arranged in rows and in columns perpendicular to the rows, the chevrons on one face of the pad registering with those on the opposite face of the pad. Each pad has, extending along two opposite sides, upstanding portions 82 which prevent the rail moving to the left or to the right (considering FIG. 6). Each upstanding portion has an inclined face 83, remote from the rail, in contact with a side wall of the recess 72 in the sleeper and above that has two sideways-extending portions 84, one on each side of the clip-retaining member 50. Each of the sideways-extending portions 84 is formed at each end with a recess 85.

A clip 90, made by bending a rod of resilient steel of circular cross-section, 18 mm in diameter, so that its shape becomes substantially that of a letter e, with the axis of the entire rod lying in a single plane, has the centre arm 91 and the upper arm 92 of the e driven (downwardly, considering FIG. 7) into the passageway 20 in the bushing and since the overall width of the two arms 91 and 92 is 54.5 mm. and the bushing is compressed on being push-fitted or driven into the clip-retaining member 50, the arms 91 and 92 of the clip are gripped and are immobilised. The lower arm 93 of the e directly contacts the flange and bears downwardly on it. The clip is distorted to the shape shown in FIG. 6.

Figure 7:
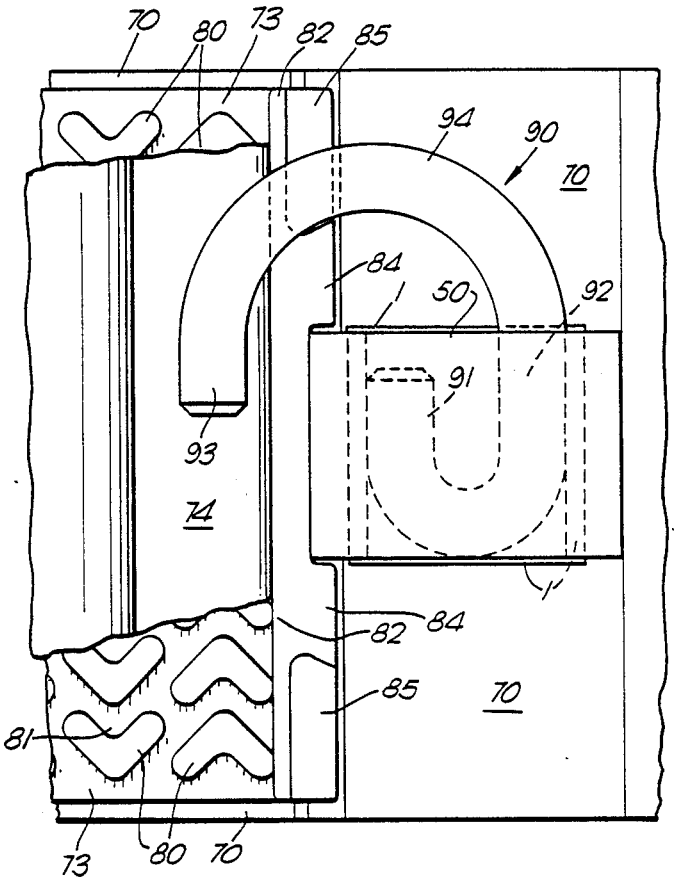

On the other side of the rail the construction is similar to that shown in FIGS. 6 and 7 but the clip is driven in the opposite direction so that its arms 91 and 92 enter the passageway 20 in the bushing 1 held in the clip-retaining member 50. On each side of the rail one or the other of the two recesses 85, according to the direction in which the clip is driven, receives a reverse bend portion 94 of the clip. The end wall of the recess 85 is abutted by the clip when the clip is driven into its position and prevents it from being driven too far.

The angle A shown in FIG. 2 is about 140.5°, the angle B about 99.5° and the angle C about 110°. These angles and the other dimensions could be altered for the same clip 90 and clip-retaining member 50 or for different clips and retaining members. The clip-retaining member 50 could be replaced by one made by casting, in which case it will have a portion underneath and engaging the surfaces 5, 6 and 8 of the bushing 1. In both cases the bushing can be withdrawn from the clip-retaining member and replaced by another bushing if necessary.

In another embodiment of the invention, the parallel sides 21 and 22 of the cross-section of the passageway 20 are substantially horizontal when a single flat upper surface of the bushing is horizontal or when two flat surfaces like the surfaces 2 and 3 are inclined to the horizontal by equal angles in opposite senses. In that embodiment the top 51 of the clip-retaining member slopes downwardly from right to left at about 12.5° to the horizontal when seen in a view corresponding to FIG. 6 so that again the sides 21 and 22 of the cross-section slope downwardly from right to left at about 12.5° to the horizontal. However, the construction shown in the drawings has the advantage that the roof of the passageway 20 can be shaped as shown in the drawings, to facilitate entry of the clip into the passageway, without great wastage of the electrically insulating material and without the insulation being too thin at any point.

I claim:

1. A bushing which is suitable for electrically insulating a railway rail-fastening clip from a retaining member for it, the bushing having an internal throughgoing passageway of elongate cross-section, as seen in a plane perpendicular to the through direction of the passageway, and externally the bushing having on its lower side substantially two flat surfaces inclined to one another by an angle which is much greater than 90°, the bushing further having on one side thereof a lateral projection which is intended to lie in an opening in a clip-retaining member when the bushing is inserted in such member, whereby the bushing is located in such member.

2. A bushing according to claim 1 in which externally the bushing has first, second, third and fourth substantially flat surfaces, with the first and second surfaces meeting one another at a first angle, the second and third surfaces meeting one another at a second angle which is much greater than 90° and the third and fourth surfaces meeting one another at a third angle.

3. A bushing according to claim 1 in which the shape of cross-section of at least part of the internal passageway is substantially the shape of a conventional athletics race track, with two substantially straight and substantially parallel sides and two substantially semi-circular ends.

4. A device which is suitable for electrically insulating a railway rail-fastening clip from a retaining member for the clip, the device being a body of electrically insulating material having a passageway of elongate cross-section through it for reception of part of the clip, the shape of cross-section of at least part of the passageway being substantially the shape of a conventional athletics race track, with two substantially straight and substantially parallel sides and two substantially semi-circular ends, and in a particular orientation of the body substantially a flat external upper surface of the body is substantially horizontal and the substantially straight and parallel sides of the cross-section of the passageway are inclined to the horizontal, the device further having on one side thereof a lateral projection which is intended to lie in an opening in a clip-retaining member when the device is inserted in such member, whereby the device is located in such member.

5. A device according to claim 4 in which said sides are inclined to the horizontal by an angle between 5° and 20°.

6. A device according to claim 4 in which said body has two opposite sides which diverge, proceeding downwardly, and their external surfaces are joined to opposite sides of said upper surface by convexly curved surfaces.

7. A device according to claim 4 in which externally the body has on its lower side two flat external surfaces inclined to one another by an angle which is much greater than 90°.

8. An assembly comprising a concrete railway sleeper, a clip-retaining member comprising anchoring means incorporated in the concrete and also comprising a clip-retaining part projecting above the concrete and formed with an opening, an insulating device which is a device according to claim 4 and which is suitable for electrically insulating a railway rail-fastening clip from the clip-retaining part, the insulating device lying in said opening.

9. An assembly according to claim 8 in which the sleeper has a recess in its upper surface, which recess has been formed by the presence of said insulating device in a mould during an operation of casting the concrete around said anchoring means to form the sleeper.

10. An assembly according to claim 8 in which the sides of the cross-section of the passageway slope downwardly, proceeding towards the rail, at an angle between 5° and 20°.

11. A device which is suitable for electrically insulating a railway rail-fastening clip from a retaining member for the clip, the device being a body of electrically insulating material having a passageway through it for reception of part of the clip, the shape of cross-section of at least part of the passageway being substantially the shape of a conventional athletics race track, with two substantially straight and substantially parallel sides and two substantially semi-circular ends, and in a particular orientation of the body substantially a flat external upper surface of the body is substantially horizontal and the substantially straight and parallel sides of the cross-section of the passageway are inclined to the horizontal by an angle between 5° and 20°.

12. A device which is suitable for electrically insulating a railway rail-fastening clip from a retaining member for the clip, the device being a body of electrically insulating material having a passageway through it for reception of part of the clip, the shape of cross-section of at least part of the passageway being substantially the shape of a conventional athletics race track, with two substantially straight and substantially parallel sides and two substantially semi-circular ends, and in a particular orientation of the body substantially a flat external upper surface of the body is substantially horizontal and the substantially straight and parallel sides of the cross-section of the passageway are inclined to the horizontal, said body having two opposite sides which diverge, proceeding downwardly, and their external surfaces being joined to opposite sides of said upper surface by convexly curved surfaces.

13. An assembly comprising a concrete railway sleeper, a clip-retaining member, which comprises anchoring means incorporated in the concrete and also comprises a clip-retaining part projecting above the concrete and formed with an opening, and an insulating device lying in said opening, said device being suitable for electrically insulating a railway rail-fastening clip from the clip-retaining part and being a body of electrically insulating material having a passageway through it for reception of part of the clip, the shape of cross-section of at least part of the passageway being substantially the shape of a conventional athletics race track, with two substantially straight and substantially parallel sides and two substantially semi-circular ends, and in a particular orientation of the body substantially a flat external upper surface of the body is substantially horizontal and the substantially straight and parallel sides of the cross-section of the passageway are inclined to the horizontal.

14. An assembly according to claim 13 in which the sleeper has a recess in its upper surface, which recess has been formed by the presence of said insulating device in a mould during an operation of casting the concrete around said anchoring means to form the sleeper.

15. An assembly according to claim 13 in which the sides of the cross-section of the passageway slope downwardly, proceeding towards the rail, at an angle between 5° and 20°.

* * * * *